United States Patent [19]

Garnett

[11] 4,174,785

[45] Nov. 20, 1979

[54] MULTIPLE PERIPHERAL SEAL FOR STORAGE TANK FLOATING DECK

[75] Inventor: Albert C. Garnett, Allentown, Pa.

[73] Assignee: Swiss Aluminium Ltd., Chippis, Switzerland

[21] Appl. No.: 792,448

[22] Filed: Apr. 29, 1977

[51] Int. Cl.[2] ..... B65D 87/20

[52] U.S. Cl. ..... 220/224; 277/138

[58] Field of Search ..... 277/4, 138; 220/216–227

[56] References Cited

U.S. PATENT DOCUMENTS

| | | | |
|---|---|---|---|
| 2,072,798 | 3/1937 | Cranz | 220/222 |
| 2,327,083 | 8/1943 | Wiggins | 220/224 |
| 2,329,965 | 9/1943 | Wiggins | 220/224 |
| 2,427,171 | 9/1947 | Wiggins | 220/222 |
| 2,459,178 | 1/1949 | Moyer | 220/224 |
| 2,495,755 | 1/1950 | Orr et al. | 220/224 |
| 3,079,029 | 2/1963 | Moyer et al. | 220/226 |
| 3,119,511 | 1/1964 | Giannini | 220/226 |
| 3,125,346 | 3/1964 | Poltorak | 220/226 |
| 3,426,934 | 2/1969 | Marulic | 220/226 |
| 4,014,454 | 3/1977 | Nayler et al. | 220/226 |

FOREIGN PATENT DOCUMENTS

| | | | |
|---|---|---|---|
| 540391 | 12/1931 | Fed. Rep. of Germany | 220/26 |

*Primary Examiner*—Robert I. Smith

*Attorney, Agent, or Firm*—Bachman and LaPointe

[57] ABSTRACT

Adjustable flexible sealing members for the peripheral edge of a floating deck are disclosed. At least two sealing members are attached to the peripheral edge of the floating deck in such a manner that both vertical and horizontal movement of the members may be adjusted from the surface of the floating deck. Such sealing members greatly reduce or eliminate the evaporative loss from volatile liquids protected by the floating deck in a storage tank.

8 Claims, 2 Drawing Figures

MULTIPLE PERIPHERAL SEAL FOR STORAGE TANK FLOATING DECK

BACKGROUND OF THE INVENTION

This invention relates in general to a floating deck apparatus for placement above the surface of a volatile liquid in a storage tank. In particular, the present invention relates to an improved method of sealing the annular space between the floating deck edge and the interior of the storage tank walls by providing for multiple wiper assemblies to limit evaporation of the volatile liquid.

Floating decks, which may include internal floating covers, internal floating pans or external floating roofs, have become the main means of preventing evaporation losses from storage tanks containing volatile liquids such as petroleum and petroleum distillates. Such decks help to form a seal within the storage tank and the decks rise and fall with the volatile liquid level within the tank to further prevent excessive evaporation losses. A means for improving the annular seal between the edge surfaces of such floating decks and the interior wall surfaces of the storage tanks is desperately needed with today's shortages of petroleum products throughout the manufacturing world.

There have been many attempts to provide such an annular seal for floating decks. Such seals tend to fit into four classifications, namely a solid flexible wiper, a fabric encased foam, a liquid filled plastic envelope or a plastic log. Such seals suffer from the disadvantage of not fully sealing the annular space between the folating deck and the interior of the storage tank from volatile liquid evaporation. In particular, since storage tanks cannot be made either perfectly round or with perfectly smooth interior wall surfaces, sealing assemblies of the prior art have become subjected to loss of sealing as the sealing arrangements pass over irregularities in the storage tank inner wall surfaces. Such loss of sealing may be the result of the former sealing arrangements passing over and being forced inward by such obstructions as rivet heads, weld seams or lap joints utilized in the actual formation of the storage tank walls.

Accordingly, it is a principal object of the present invention to provide an improved sealing arrangement for storage tank floating decks.

A further object of the present invention is to provide a sealing arrangement for the peripheral edge of such a deck as outlined above which minimizes evaporative losses from the storage tank.

It is an additional object of the present invention to provide a multiple peripheral seal for floating decks which is capable of overcoming irregularities in the inner wall surfaces of such a storage tank as outlined above in order to further minimize evaporative losses from such a tank.

Further objects and advantages of the present invention will become apparent from a consideration of the following specification.

SUMMARY OF THE INVENTION

The multiple peripheral seal of the present invention utilizes at least two flexible sealing members which are adjustably attached to the peripheral edge of the floating deck. Previous multiple seals or multiple-effect seals have been utilized in the prior art (for example, U.S. Pat. Nos. 2,307,508, 3,135,415 and 3,333,725). Such previous multiple seals have not exhibited the adjustable advantages of the multiple peripheral seal utilized in the present invention.

In particular, the multiple peripheral seal for use with a floating deck comprises:

(a) at least two flexible sealing members adjustably attached to the peripheral edge of said floating deck;

(b) flexible material which is impervious to the liquid or vapors generated beneath the flexible members, said material being attached between each flexible member to provide additional protection against evaporative losses;

(c) adjustable securing means securing said flexible members to the peripheral edge of said floating deck, said securing means permitting both vertical and horizontal adjustment of said flexible members relative to the surface of said floating deck; and (d) optional stiffening members placed on each face of said flexible members and secured to said flexible members by the same adjustable securing means utilized to adjustably secure said members to the peripheral edge of said floating deck.

The flexible members may themselves be covered with an abrasion resistant coating or covering, which should be compatible with the volatile liquid in the tank. The flexible members should be secured to the floating deck in such a manner that the lowermost flexible member should be spaced above the level of the volatile liquid under the floating deck.

DETAILED DESCRIPTION

While it is to be understood that the floating deck to which the multiple peripheral seal of the present invention is attached may be employed in any type or shape of vertical liquid storage tank, the most common use for such a seal would be in a cylindrical vertical liquid storage tank such as is commonly used for storage of petroleum based volatile fluids. The floating deck to which the seal of the present invention is attached would therefore utilize a circular sheet of reinforced material which may be formed from a single piece or multiple pieces of metal or other material which is generally impervious to the volatile fluid and the vapor generated by the volatile fluid being protected by the floating deck. In particular, the floating deck may be formed from aluminum, reinforced plastics or other material, which may be reinforced to provide structural rigidity to the floating deck. The floating deck may be formed from other configurations of material such as honeycomb material and other designs which provide strength.

Due to the irregularities present in the storage tank walls, the floating deck cannot be formed to fit within the storage tank in such a manner so that the deck completely seals evaporation of the volatile liquid within the tank. Such a procedure would require extreme care both in fabricating the storage tanks and in fabricating the floating decks. Such care would make such floating decks prohibitively expensive and would therefore limit the usefulness of such decks.

Accordingly, a means of sealing the annular space between the peripheral edge of the floating deck and the inside wall of the storage tank must be provided in order to utilize mass production techniques in the formation of the floating deck for greater cost effectiveness. Such a peripheral seal would also greatly reduce or eliminate entirely any evaporative losses from the volatile fluid protected by the floating deck and would also prevent the introduction of foreign material from above the floating deck into the liquid within the tank.

Figure 2:
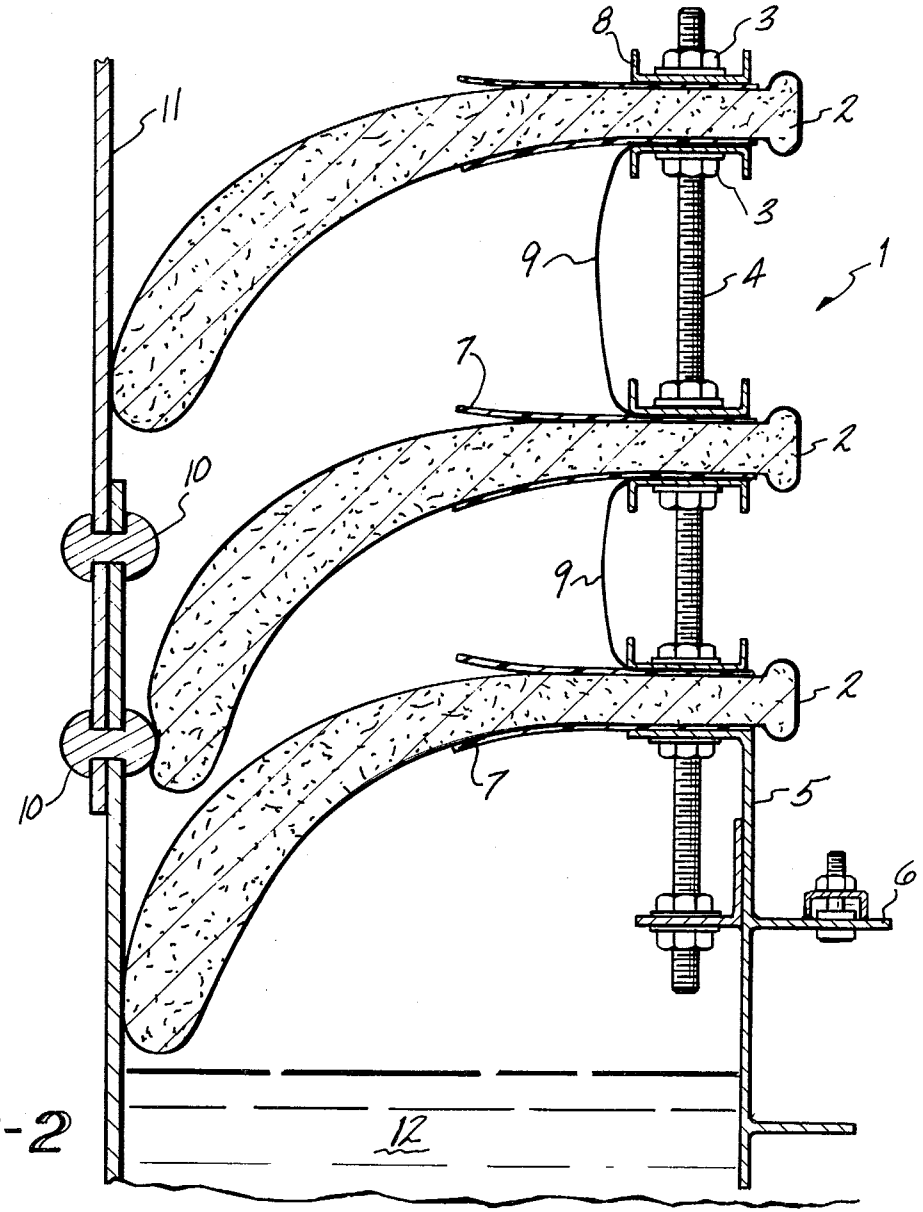
FIG. 2 is a sectional view of the adjustable multiple peripheral seal utilized in the present invention.
Figure 1:
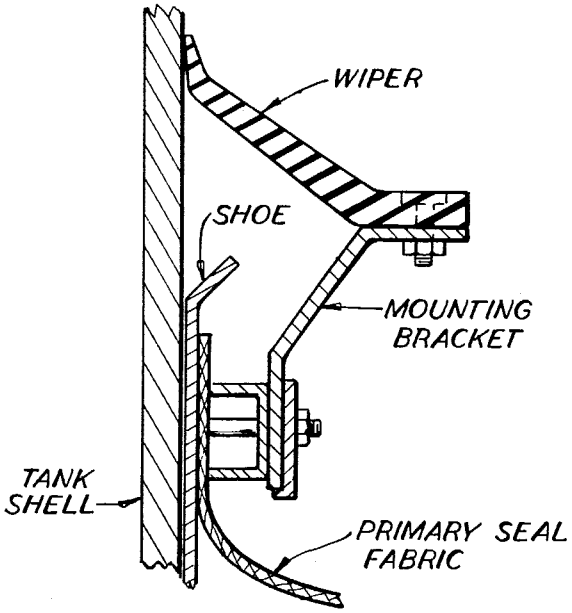
FIG. 1 is a sectional view of a typical peripheral seal known in the prior art.

The peripheral seal of the present invention utilizes at least two flexible members to provide for greater sealing protection. Referring to FIG. 2, the overall peripheral seal assembly 1 incorporates three flexible members 2 which are attached with fastening nuts 3 to a threaded rod 4, which in turn is attached to the peripheral edge 5 of floating deck 6. The flexible members may be held in place by stiffening members 7 which are retained by retaining members 8 secured by the adjustable nuts 3. Vapor proof sheet material 9 is secured between said flexible members 2 by said retaining means 8. FIG. 2 further illustrates the main edge enjoyed by the peripheral seal of the present invention. The metal flexible member 2 is shown being deformed by a rivet head 10 securing the plates used to form the storage tank wall 11. The deformation caused by such rivet heads could cause a vapor loss through the annular space protected by the peripheral seal. It should be noted that the peripheral seal of the present invention provides for multiple sealing against this evaporative loss even when one of the flexible members is pushed in by an obstruction to cause a break in its particular sealing effectiveness. Therefore, the seal of the present invention provides at least one backup seal for protection of the volatile liquid within the storage tank.

The flexible members utilized as the sealing elements in the present invention may be formed from either solid or foamed resilient material which is impervious to the volatile liquid or its vapor. It is preferable that the flexible members be formed from either a solid or foamed plastic material which is impervious to most petroleum distillates as well as other liquid chemicals. For example, the flexible members may be formed from polyurethane foam which is so formulated as to provide desirable stiffness without loss of resiliency. The cross-sectional area of the flexible members or the sealer material utilized in the members may be varied to supply desirable stiffness in the members without resorting to separate stiffening members. The sheet material placed between each flexible member should should be formed of fabric or solid sheet which is also impervious to the volatile liquid or its vapor. The material may be formed from the same material utilized to form the flexible members or it may be formed from different material. For example, such material may be formed from polyester sheet or fabric which has been coated with a polyurethane film.

The mounting assembly should preferably be formed from the same material utilized to form the floating deck. This helps to prevent corrosion problems and eliminates any possibility of spontaneous electrical discharge within the tank due to galvanic action. The securing members and retaining means should also be formed from the same material. The stiffening members, if utilized, may be formed from metal, for high flexibility and high fatigue strength, or from a plastic material which also exhibits high fatigue strength. The flexible members may be provided with a surface coating or a sheet or fabric covering in order to reduce the effects of abrasion upon the flexible members as they traverse the walls of the storage tank.

The distance between each flexible member on the mounting means is variable with the provision that the lowermost flexible member be mounted so that no portion of said flexible member is in contact with the volatile liquid. Of course, if more than two flexible members are placed upon the mounting means, they may be mounted with equal spacing between each member. Such spacing is not, however, necessary for the performance of the multiple peripheral seal.

A further advantage of the present invention lies in the fact that a worker may adjust the spacing between each flexible member or may adjust the horizontal movement of each flexible member without dismantling the seal assembly. Such adjustment may be made by the worker by standing upon the floating deck surface and simply adjusting the securing means to any desired position. Such inside availability of the securing means enables the flexible members and the impervious sheet material between each member to remain in place for continuous sealing of vapor from the volatile liquid in the tank.

As can be seen from the discussion presented hereinabove, the multiple peripheral seal of the present invention presents distinct advantages over the peripheral seals heretofore utilized in this particular art. The multiple peripheral seal of the present invention not only provides for improved and adjustable sealing ability, but also provides for greater access of the seal to adjustment after the seal has been placed in position.

It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to enccompass all such modifications which are within its spirit and scope as defined by the claims.

What is claimed is:

1. A seal for use in a storage tank for volatile liquids, said tank having a tank shell and a floating deck provided with a peripheral edge spaced radially inwardly from said tank shell, comprising:

(a) at least two separate flexible sealing members attached to the peripheral edge of said floating deck, said members being formed from solid resilient material which is impervious to the volatile liquid or vapors within said tank;

(b) securing means secured to the peripheral edge of said floating tank and secured to said members, said securing means being situated at least in part vertically upwardly from said peripheral edge, said members being individually adjustably attached to said securing means relative to each other in vertical spaced relationship to each other and to said peripheral edge in such a manner as to permit vertical and horizontal adjustment thereof relative to the surface of said floating deck and to each other, wherein said members are separately secured to said securing means by separate holding means for holding said members in place to provide an improved, adjustable sealing arrangement which minimizes evaporative losses from the storage tank.

2. A seal as in claim 1 wherein said flexible sealing members are formed from foamed resilient material which is impervious to the volatile liquid or vapors within said tank.

3. A seal as in claim 1 wherein stiffening members are placed on each face of said flexible members and secured to said flexible members by said holding means.

4. A seal as in claim 3 wherein said flexible sealing members and said stiffening members are adjustably secured to a threaded rod which is in turn attached to the peripheral edge of said floating deck.

5. A seal as in claim 3 wherein said stiffening members are formed from metal which exhibits high flexibility and high fatigue strength.

6. A seal as in claim 1 wherein said flexible members are provided with an abrasion resistant surface coating or fabric covering.

7. A seal as in claim 1 wherein at least three flexible sealing members are adjustably attached to the peripheral edge of said floating deck in vertical, spaced relationship to each other and to said peripheral edge.

8. A seal according to claim 1 including vapor proof sheet material secured to said securing means between said flexible sealing members.

* * * * *